United States Patent [19]

Sterk et al.

[11] 4,200,061

[45] Apr. 29, 1980

[54] STEAM GENERATOR FOR NUCLEAR POWER PLANTS, ESPECIALLY FOR PRESSURIZED WATER REACTORS

[75] Inventors: Zvonimir Sterk, Erlangen; Martin Sawitzki, Röttenbach; Heinz Grimm, Erlangen, all of Fed. Rep. of Germany

[73] Assignee: Kraftwerk Union Aktiengesellschaft, Mülheim, Fed. Rep. of Germany

[21] Appl. No.: 931,022

[22] Filed: Aug. 4, 1978

[30] Foreign Application Priority Data

Aug. 5, 1977 [DE] Fed. Rep. of Germany ..... 2735450

[51] Int. Cl.[2] ..... F22B 1/02; F28F 7/00; F28F 9/02

[52] U.S. Cl. ..... 122/32; 165/76; 165/158

[58] Field of Search ..... 122/32, 33, 34; 165/76, 165/74, 158

[56] References Cited

U.S. PATENT DOCUMENTS

| | | | |
|---|---|---|---|
| 3,734,175 | 5/1973 | Christensen | 165/158 |
| 3,768,550 | 10/1973 | Williamson et al. | 165/158 |
| 3,833,055 | 9/1974 | Munz et al. | 165/158 |
| 3,896,873 | 7/1975 | Wolowodiuk et al. | 165/76 |
| 3,948,315 | 4/1976 | Powell | 165/76 |

*Primary Examiner*—Kenneth W. Sprague
*Attorney, Agent, or Firm*—Herbert L. Lerner

[57] ABSTRACT

Steam generator for nuclear power plants including a cylindrical housing, a tube bundle for conducting primary medium enclosed by the housing, at least one tube support plate holding the tube bundle, the cylindrical housing including a base member secured to the tube support plate and defining therewith inlet and outlet chambers for the primary medium, the cylindrical housing having a pair of opposing flanges on portions of the cylindrical housing located on opposite sides of the tube support plate, and flange connection means for tightly connecting the portions of the cylindrical housing on opposite sides of the tube support plate, the flange connection means being releasable for assembling and disassembling the tube bundle and including a stud bolt connection, the flanges having opposing sealing surfaces, a lip seal disposed between the sealing surfaces and having radially outwardly protruding lips tightly welded to one another, the lips having a radially inner region secured by respective circular bead welds to the flanges.

11 Claims, 3 Drawing Figures

STEAM GENERATOR FOR NUCLEAR POWER PLANTS, ESPECIALLY FOR PRESSURIZED WATER REACTORS

The invention relates to a steam generator for nuclear power plants, especially for pressurized water reactors, comprising a cylindrical housing, a tube bundle for conducting primary medium enclosed by the housing, as well as at least one tube support plate or sheet holding the tube bundle, the tube support plate, together with a preferably hemispherical base defining inlet and/or outlet chambers for the primary medium, portions of the steam generator housing located on opposite sides of tube support plate being tightly connected to one another by flange connection means which are releasable or detachable for assembling and disassembling the tube bundle.

Such a steam generator has become known heretofore from German Petty Patent DT-GM No. 3 312 164. It is readily reparable because, after loosening a first lower flange connection, the base defining the primary chamber can be removed and the tube support plate is thereby made readily accessible; furthermore, a housing portion enveloping the tube support plate with the U-tube bundle can be disassembled by loosening a second flange connection. The problem of the tightness or integrity of the flange connections arises, however. The reactor primary coolant is at a pressure of about 160 bar at an inlet temperature of about 323° C., and the secondary medium on the secondary side of the steam generator is under a pressure of about 60 bar at a coolant outlet temperature of about 280° C. The flange connection must not only be pressure-tight, but must also be able to withstand the stresses resulting from temperature variations during start-up, shut-down and load changes. During the heating-up process, the flange bolts are subjected to increased tensile stress, since they heat up with time delay and therefore have a thermal expansion which lags behind that of the other parts of the steam generator. Overelongation or expansion can then readily result.

It is accordingly an object of the invention to provide a flange connection in a steam generator of the foregoing general type which effectively avoids the hereinaforementioned difficulties i.e. the flange connection always retains its tightness within the ordinary operating conditions even if the flange bolts thereof are stressed due to temperature variations.

It is another object of the invention to provide such a steam generator wherein good accessibiltiy to the flange connection is afforded for easy assembly and disassembly and, thereby, ease of repair.

With the foregoing and other objects in view, there is provided, in accordance with the invention, a steam generator for nuclear power plants comprising a cylindrical housing, a tube bundle for conducting primary medium enclosed by the housing, at least one tube support plate holding the tube bundle, the cylindrical housing including a base member secured to the tube support plate and defining therewith inlet and outlet chambers for the primary medium, the cylindrical housing having a pair of opposing flanges on portions of the cylindrical housing located on opposite sides of the tube support plate, and flange connection means for tightly connecting the portions of the cylindrical housing on opposite sides of the tube support plate, the flange connection means being releasable for assembling and disassembling the tube bundle and comprising a stud bolt connection, the flange having opposing sealing surfaces, a lip seal disposed between the sealing surfaces and having radially outwardly protruding lips tightly welded to one another, the lips having a radially inner region secured by respective circular bead welds to the flanges.

In this manner, the heat transfer surfaces between the flange bolts and the flange are considerably increased, so that the heat flux can also flow from the flanges into the flange bolts without any appreciate throttling action. A time delay in the course or characteristic of the temperature of the flange bolts with respect to the other parts of the flange is thereby virtually avoided. The flange bolts cannot be over-elongated or over-expanded, and the flange connection, in conjunction with the thermoelastic lip seal, retains its tightness.

In accordance with another feature of the invention, one of the flanges is at the tube support plate, and the other of the flanges is on the base member, the base member being formed as a hemispherical housing base and stud bolts extending through throughbores formed in the flange on the base member and having respective threaded bases threadedly secured in threaded bores formed in the tube support-plate flange, and respective threaded heads at the other ends thereof facing away from the tube support plate and protruding from the base-member flange, and tightening nuts threadedly secured on the threaded heads.

In accordance with a further feature of the invention, the steam generator includes primary-medium inlet and outlet unions connected at an inclination from below to the hemispherical base, the inlet and outlet unions having respective axes inclined to the longitudinal axis of the cylindrical housing to an extent that a ring zone wherein the base-member flange is disposed is located beyond, an axial projection of the unions.

In accordance with an added feature of the invention, the unions have, for a respective diameter and length, an inclination angle $\alpha$ with the longitudinal axis of the cylindrical housing which is smaller than 40° and preferably is 30°.

In accordance with an additional feature of the invention, further flange connection means are longitudinally spaced from the first-mentioned flange connection means and located in a region of the steam generator housing wherein the tube bundle is disposed, the further flange connection means also comprising a stud-bolt connection.

In accordance with yet another feature of the invention, the tube bundle comprises a multiplicity of U-tubes, and the steam generator is a U-tube steam generator.

In accordance with yet a further feature of the invention, the U-tube bundle has a cold leg, and including a preheating chamber in a region of the cold leg near the tube support plate, the further flange connection means being located above the preheating chamber.

In accordance with yet an added feature of the invention, one of the flanges is at the tube support plate, and the other of the flanges is on the base member, the base member being formed as a hemispherical housing base, and stud bolts extending through through-bores formed in the flange on the base member and having respective threaded bases threadedly secured in threaded bores formed in the tube support-plae flange, and respectively threaded heads at the other ends thereof facing away from the tube support plate and protruding from the base-member flange, and tightening nuts threadedly secured on the threaded heads, the tube support-plate flange being formed with additional bores coaxial with the threaded bores formed therein for affording access to a lifting tool for lifting the stud bolts, the threaded bases of the stud bolts being formed with a threaded blind bore, for threadedly securing therein means for attaching the lifting tool to the stud bolts.

In accordance with yet an additional feature of the invention, the flange sealing surfaces have an austenitic plating, the lip seal being formed of austenitic material and having ring plating surfaces welded thereto and accessible from outside the housing.

In accordance with a concomitant feature of the invention, the lip seal comprises two mutually associated sealing rings, each having a semicircularly protruding lip, the lips having a mutually abutting joint and being weldable thereat to form a circumferential circular sealing bead.

Other features which are considered as characteristic for the invention are set forth in the appended claims.

Although the invention is illustrated and described herein as embodied in a steam generator for nuclear power plant, especially for pressurized water reactors, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
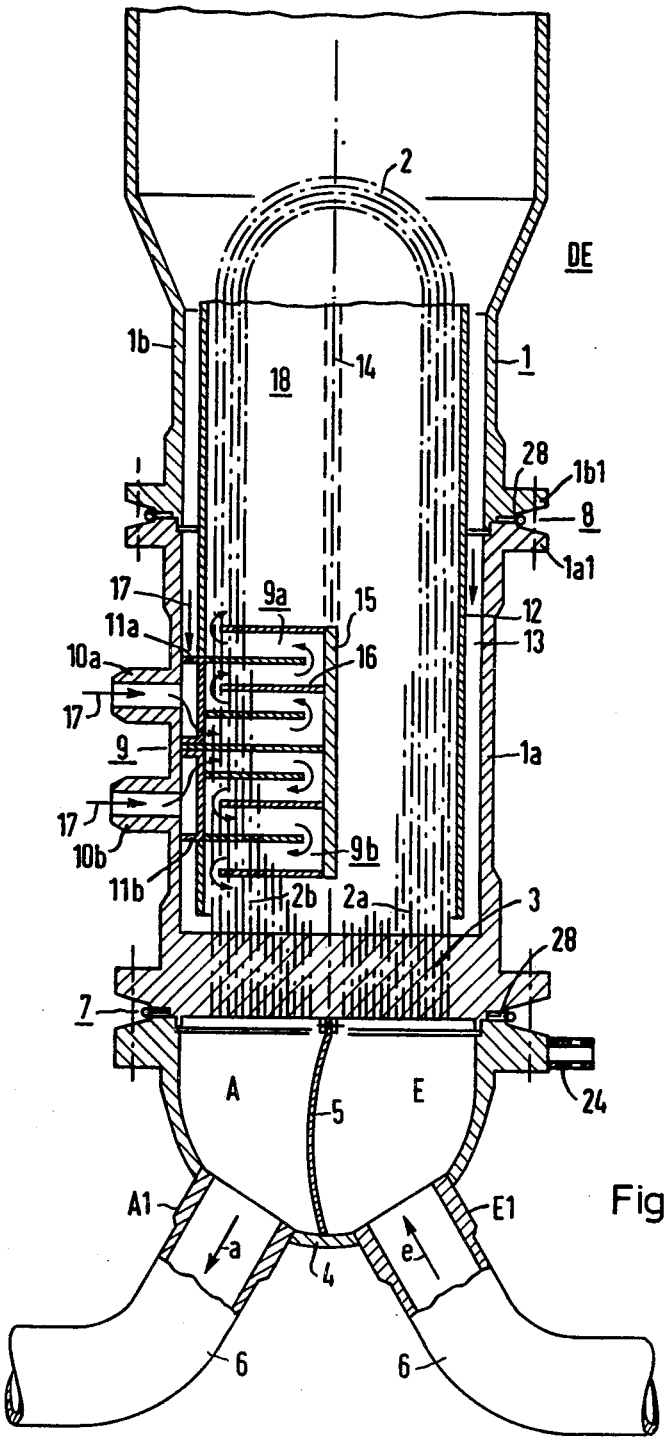
FIG. 1 is a longitudinal sectional view, partly diagrammatic, of a steam generator of the U-tube bundle type for a nuclear power plant having a pressurized-water reactor.

Referring now to the drawing and first, particularly to FIG. 1 thereof, there is shown a steam generator of the U-tube type, constructed for a thermal output power of approximately 950 $MW_{therm}$ and intended for a pressurized-water reactor which, for example, has four of these steam generators in a four-loop disposition in the primary system thereof. The steam generator, generally designated as DE, is formed of a substantially cylindrical housing 1, a U-tube bundle 2 enclosed by the housing 1, a tube support plate or sheet 3 which is welded to the middle section 1*a* of the housing 1 and wherein the hot end 2*a* and the cold end 2*b* of the tube bundle is encased, as well as a hemispherical base 4 with a partition 5. The tube support plate 3 and the tube base 4 with the partition 5 define an inlet chamber E and an outlet chamber A for primary medium, the flow direction of which is indicated by arrows e and a. For the purpose of feeding-in and discharging the primary medium, such as water, for example, as in the case at hand, an inlet union or connecting piece terminating in the inlet chamber E and an outlet union A1 terminating in the outlet chamber A are welded to the tube base 4. Pipes 6 are welded in turn, to these unions E1 and A1.

Housing sections, namely, a middle section 1*a* and the hereinforementioned base 4, respectively located on opposite sides of the tube support plate 3, are tightly connected to each other by means of a releasable flange connection 7. Similarly, a further sealing flange connection 8 is disposed between an upper part 1*b* of the housing 1 and the middle section 1*a* thereof. The housing middle section 1*a* encompasses a preheating chamber, generally designated as 9, with an upper chamber 9*a* and a lower chamber 9*b*, in which a respective feedwater nozzle 10*a*, 10*b*, terminates, in fact, through a water box or compartment 11*a*, 11*b*. The steam generator DE is a natural-circulation steam generator with a shroud or skirt 12 surrounding the tube bundle, a downcomer chamber 13 being defined by and betwee the shroud 12 and the housing 1. The shroud 12 is fastened to the housing 1 in a suitable non-illustrated manner; it serves, for its part, to fasten a partition 15, which is disposed in a tube channel 14, and together with the shroud 12, holds baffles 16 of the preheating chamber 9*a*, 9*b*, which are disposed in staggered relationship to one another. The water boxes 11*a* and 11*b*, which are likewise fastened in a suitable non-illustrated manner to the shroud 12 are of arcuate shape and are provided at the inner periphery thereof with a perforation through which the feedwater (note flow arrows 17) is introduced into the upper and lower preheating chambers 9*a* and 9*b*, wherefrom it travels into the vaporization chamber 18 through a meander-shaped or sinuous flow path represented by the arrows 17. The quantity of water which is not vaporized, as well as a quantity of water discharging from non-illustrated steam separators which are located above the tube bundle 2 flows down in the downcomer chamber or space 13, as represented by the arrows 17, in direction toward the tube support plate 3, whererfrom it is guided upwardly again within the vaporization space 18.

Figure 2:
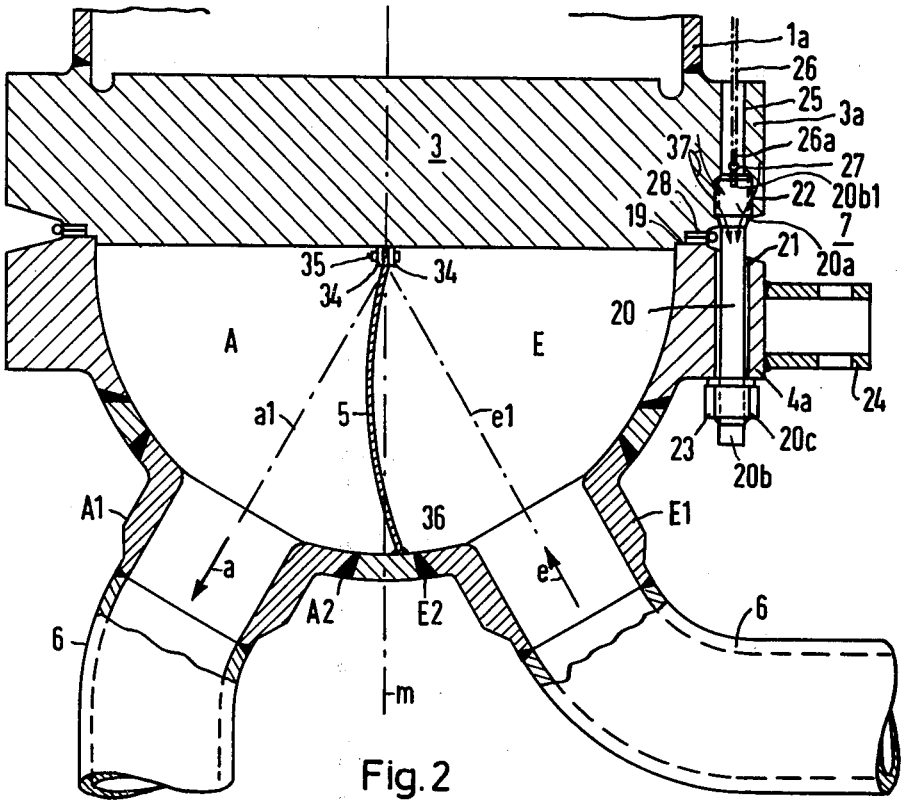
FIG. 2 is an enlarged fragmentary view of FIG. 1 showing a flange connection in the region of the tube support plate or bottom ends of the tubes.

To explain the flange connection 7 in greater detail, reference is made hereinafter to FIGS. 2 and 3, wherein parts like those in FIG. 1 have been given the same reference characters. FIG. 2 shows that the flange connection 7 is in the form of a stud bolt or tap bolt connection. In the illustrated embodiment, the joint or parting line 19 of the flange connection 7 is located between a tube support-plate flange 3*a* and an opposing flange 4*a* of the hemispherical housing base 4. The tap or stud bolts 20 extend through through-bores 21 formed in the opposing flange 21, are screwed by the threaded base 20*a* thereof into respective threaded bores 22 formed in the tube support-plate flange 3*a* and, at the other end thereof i.e. on the head side thereof, which is directed away from the tube support plate 3 and protrudes from the opposing flange 4*a*, are provided with a thread 20*c* for screwing-on tightening nuts 23. The stud bolt connection is shown in detail only on the right-hand side of FIG. 2 and indicated by dot-dash lines on the left-hand side, as shown in FIG. 1, the flange connection 8, as shown in FIG. 1, corresponding to the flange connection 7, and also being in the form of a top or stud bolt connection.

In the illustrated embodiment, two inlet and outlet unions E1 and A1 are provided, which are connected at an inclination from below to the base 4 and are practically mirror-symmetrical to one another. In this construction of FIG. 2, the nozzle axes e1, a1 are so inclined, as shown, relative to the longitudinal axis m of the housing 1 that the circular zone of the opposing flange 4*a* comes to lie outside the axial projection of the nozzles E1 and A1. In this manner, good accessibility is afforded for placing hydraulic tightening devices on the stud-bolt ends 20*b* including the nuts 23 of the stud bolts 20, as well as for applying screwing tools. With the relative diameter and lengths of the unions E1 and A1 shown, an inclination angle of $\alpha = 30°$ has been found to be advantageous; in general, an advantageous range of this inclination angle is between 40° and 30°. If the inclination angle should fall considerably below 30°, the welded seams E2 and A2 of the unions E1 and A1 would be too close together.

In the embodiment shown in FIG. 2, forty-four stud bolts are uniformly distributed over the circumference of each flange connection. This results in an adequate excess of compressive force for the stud bolts 20 without overloading the supporting threads. Four support paws 24, only one of which is visible in FIG. 2, are uniformly distributed over the circumference of, and are welded to the opposing flange 4*a*. With these support paws 24, the steam generator rests, in installed position thereof, on non-illustrated brackets of the nuclear power plant containment. FIG. 2 shows further that, associated with the threaded bores 22, wherein the respective base of the stud bolts 20 is received, are coaxial through-bores 25 of smaller diameter, which afford passage therethrough of lifting gear 26 for the stud bolts 20. For the lifting gear 26 to engage or grip the stud bolt 20, the base or bottom end 20*a* of the stud bolt 20 is formed with a blind tapped hole 20*b* into which a carrying eye 27 is screwed. Into the carrying eye 27, there is suspended a hook 26*a* of the lifting gear 26, of which, otherwise, only a section of the hoisting cable is illustrated. In the illustrated steam generator, the weight of an individual stud bolt 20 is approximately 560 kg. To handle stud bolts of such weight, especially under spatially restricted conditions or relationships, the suspension of the stud bolts, from the lifting gearing 26 when the screw bolts are being screwed in and out is advantageous for the purpose of effecting weight relief of the threads.

Figure 3:
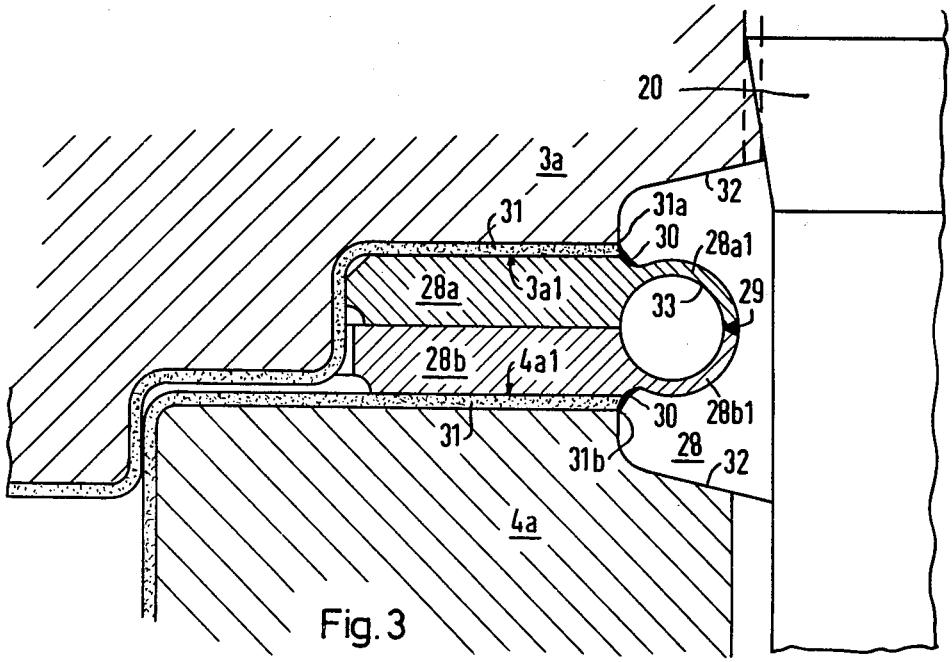
FIG. 3 is a further enlarged fragmentary view of FIG. 2 showing a lip seal thereof.

The flange seal generally designated in FIGS. 1 and 2 as 28 is shown much enlarged in the detailed view thereof in FIG. 3. Between the mutually juxtaposed sealing surfaces 3*a*1 and 4*a*1 of the flanges 3*a* and 4*a*, the lip seal 28 is inserted, formed of two sealing rings 28*a* and 28*b* and respective outwardly-protruding lips 28*a*1 and 28*b*1 which are welded together (welded seam 29) and are also welded tightly in the root region thereof to the respective flanges 3*a* and 4*a* by means of circumferential circular seams 30. As can be seen, the flange sealing surfaces 3*a*1 and 4*a*1 are respectively provided with austenitic plating 31; the lip seal 28 likewise being formed of austenitic material and being welded to the annular plating surfaces 31*a* and 31*b* which are accessible from the outside (see the hereinafore mentioned circular welding seams 30). The welding seam 29 is also a circumferential circular welded seam, so that it is possible, when releasing or loosening the flange connectin 7 and, similarly, when loosening the flange connection 8, to cut open, weld open or grind open the circular welded seams in a relatively simple manner, just as it is also possible to effect the welded seams because of the good accessibility. To this end, the flanges 3*a* and 4*a* and similarly, also the flanges 1*b*1 and 1*a*1 of the flange connection 8 (FIG. 1) are provided with bevels 32 (FIG. 3). As can be seen, the two mutually associated sealing rings 28*a* and 28*b* form respective semicircular protruding lips 28*a*1 and 28*b*1, which are welded by the hereinafore mentioned circumferential welded seam 29 in a region thereof in which they form an abutting joint, thereby forming a circumferential circular sealing bead 33.

For simplification, the U-tube bundle is not shown in FIG. 2. However, the fastening of the curved partition 5 can be seen in detail in FIG. 2, the partitions being bolted at the upper edge thereof between two holding strips to the underside of the tube base 3 at 35, and being tightly welded to the base 4 at 36 with the remaining rounded edge thereof, which corresponds to the shape of the base 4.

As can be seen from FIG. 1, the second flange connection 8, in the embodiment of a steam generator having a preheating chamber 9, is disposed above the preheating chamber 9. In this manner, the middle section 1*a* of the housing, including the U-tube bundle and the preheating chamber 9, can be detached from the rest of the steam generator by opening the second flange connection 8 after the flange connection 7 is released or loosened and the base 4 is moved away, and can be transported to an inspection location, advantageously after storage thereof in a spent-fuel pit and after contamination. If the invention is incorporated into a straight-tube steam generator, one flange connection must be associated with each of the tube support plates or sheets thereof. In case this steam generator should also include a preheater which is fastened in a region of the housing, then this region should be made detachable or releasable by a further flange connection in order to detach or release the straight-tube bundle from the rest of the steam generator. The arrows 37 in FIG. 2 further indicate the heat flux which flows from the tube support plate or sheet 3 into the stud bolts 20 when the steam generator DE is heated up. As is readily apparent, a sufficiently large heat transfer area is provided, so that the flange bolts 20 can heat up and expand with the tube support plate of sheet 3 without detrimental delay. The cooling-down process is correspondingly similar.

There is claimed:

1. Steam generator for nuclear power plants comprising a cylindrical housing, a tube bundle for conducting primary medium enclosed by said housing, at least one tube support plate holding said tube bundle, said cylindrical housing including a base member secured to said tube support plate and defining therewith inlet and outlet chambers for the primary medium, said cylindrical housing having a pair of opposing flanges on portions of said cylindrical housing located on opposite sides of said tube support plate, and flange connection means for tightly connecting said portions of said cylindrical housing on opposite sides of said tube support plate, said flange connection means being releasable for assembling and disassembling said tube bundle and comprising a stud bolt connection, said flanges having opposing sealing surfaces, a lip seal disposed between said sealing surfaces and having radially outwardly protruding lips tightly welded to one another, said lips having a radially inner region secured by respective circular bead welds to said flanges.

2. Steam generator according to claim 1 wherein one of said flanges is at said tube support plate, and the other of said flanges is on said base member, said base member being formed as a hemispherical housing base, and stud bolts extending through through-bores formed in said flange on said base member and having respective threaded bases threadedly secured in threaded bores formed in said tube support-plate flange, and respective threaded heads at the other ends thereof facing away from said tube support plate and protruding from said base-member flange, and tightening nuts threadedly secured on said threaded heads.

3. Steam generator according to claim 2 including primary-medium inlet and outlet unions connected at an inclination from below to said hemispherical base, said inlet and outlet unions having respective axes inclined to the longitudinal axis of said cylindrical housing to an extent that a ring zone wherein said base-member flange is disposed is located beyond an axial projection of said unions.

4. Steam generator according to claim 3 wherein said unions have, for a respective diameter and length, an inclination angle $\alpha$ with the longitudinal axis of said cylindrical housing which is smaller than 40°.

5. Steam generator according to claim 4 wherein said inclination angle is 30°.

6. Steam generator according to claim 1 including further flange connection means longitudinally spaced from said first-mentioned flange connection means and located in a region of the steam generator housing wherein said tube bundle is disposed, said further flange connection means also comprising a stud bolt connection.

7. Steam generator according to claim 1 wherein said tube bundle comprises a multiplicity of U-tubes, and the steam generator is a U-tube steam generator.

8. Steam generator according to claim 7 wherein said U-tube bundle has a cold leg, and including a preheating chamber in a region of said cold leg near said tube support plate, said further flange connection means being located above said preheating chamber.

9. Steam generator according to claim 1 wherein one of said flanges is at said tube support plate, and the other of said flanges is on said base member, said base member being formed as a hemispherical housing base, and stud bolts extending through through-bores formed in said flange on said base member and having respective threaded bases threadedly secured in threaded bores formed in said tube support-plate flange, and respective threaded heads at the other ends thereof facing away from said tube support plate and protruding from said base-member flange, and tightening nuts threadedly secured on said threaded heads, said tube support-plate flange being formed with additional bores coaxial with the threaded bores formed therein for affording access to a lifting tool for lifting said stub dolts, said threaded bases of said stud bolts being formed with a threaded blind bore for threadedly securing therein means for attaching said lifting tool to said stud bolts.

10. Steam generator according to claim 1 wherein said flange sealing surfaces have an austenitic plating, said lip seal being formed of austenitic material and having ring plating surfaces welded thereto and accessible from outside said housing.

11. Steam generator according to claim 1 wherein said lip seal comprises two mutually associated sealing rings, each having a semicircularly protruding lip, said lips having a mutually abutting joint and being weldable thereat to form a circumferential circular sealing bead.

* * * * *